US010688779B2

(12) United States Patent
Yamamoto et al.

(10) Patent No.: US 10,688,779 B2
(45) Date of Patent: Jun. 23, 2020

(54) SCREEN PRINTING APPARATUS AND SCREEN PRINTING METHOD

(71) Applicant: Panasonic Intellectual Property Management Co., Ltd., Osaka (JP)

(72) Inventors: Takahiro Yamamoto, Fukuoka (JP); Minoru Murakami, Fukuoka (JP); Shuichi Tomeoku, Fukuoka (JP); Takaaki Sakaue, Yamanashi (JP); Takashi Katsuki, Yamanashi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 133 days.

(21) Appl. No.: 15/881,966

(22) Filed: Jan. 29, 2018

(65) Prior Publication Data

US 2018/0229495 A1 Aug. 16, 2018

(30) Foreign Application Priority Data

Feb. 14, 2017 (JP) ..... 2017-025192

(51) Int. Cl.

| | |
|---|---|
| ***B41F 15/08*** | (2006.01) |
| ***B41F 15/12*** | (2006.01) |
| ***B41F 15/36*** | (2006.01) |
| ***B41F 33/00*** | (2006.01) |
| ***B41F 15/44*** | (2006.01) |
| ***B41F 15/46*** | (2006.01) |

(52) U.S. Cl.

CPC ..... *B41F 33/00* (2013.01); *B41F 15/0881* (2013.01); *B41F 15/36* (2013.01); *B41F 15/44* (2013.01); *B41F 15/46* (2013.01)

(58) Field of Classification Search

CPC ..... B41F 15/0881; B41F 15/36; B41F 15/44; B41F 15/46; B41F 33/00; B41F 15/0818; B41F 15/085; B41F 15/16; B41F 15/26; B41F 15/34; B41F 15/40; B41F 33/0018; B41F 33/04; B41F 33/12; B41M 1/12; H05K 3/1216; H05K 3/1225; H05K 3/1233

USPC ..... 101/123, 129

See application file for complete search history.

(56) References Cited

U.S. PATENT DOCUMENTS 6,979,814 B2 * 12/2005 Kudo ..... F16P 3/144 250/221
10,086,600 B2 * 10/2018 Mantani ..... B41F 15/34

(Continued)

FOREIGN PATENT DOCUMENTS

| | | | | |
|---|---|---|---|---|
| EP | 2933662 | * | 10/2015 | ..... G01V 8/20 |
| JP | 2861332 B2 | | 2/1999 | |
| JP | 2010114169 | * | 5/2010 | ..... H05K 13/02 |

*Primary Examiner* — Leslie J Evanisko
*Assistant Examiner* — Marissa Ferguson-Samreth
(74) *Attorney, Agent, or Firm* — Pearne & Gordon LLP

(57) ABSTRACT

A screen printing apparatus includes an inspection region setter and an operation stop controller. The inspection region setter sets an inspection region in an inspection plane that intersects with a moving path of a mask until the mask positioned at a printing-job performing position moves to a mask shelter position by the moving mechanism. In addition, the inspection region setter excludes a passing region of the mask from the inspection region while the mask to be positioned at the mask shelter position passes over the inspection plane from the printing-job performing position.

13 Claims, 14 Drawing Sheets

(56) References Cited

U.S. PATENT DOCUMENTS

| | | | | |
|---|---|---|---|---|
| 2005/0121429 | A1* | 6/2005 | Liao | B23K 26/10 219/121.78 |
| 2009/0020944 | A1* | 1/2009 | Ide | B41F 21/08 271/207 |
| 2011/0192296 | A1* | 8/2011 | Kim | H05K 3/1225 101/127.1 |
| 2018/0067227 | A1* | 3/2018 | Eble | F21V 15/01 |

* cited by examiner

SCREEN PRINTING APPARATUS AND SCREEN PRINTING METHOD

BACKGROUND

1. Technical Field

The present disclosure relates to a screen printing apparatus and a screen printing method in which printing paste is performed on a board via a mask.

2. Description of the Related Art

In the related art, a screen printing apparatus has a configuration in which a mask provided with pattern openings is caused to come into contact with a board and paste is scraped on the mask by a squeegee such that printing with the paste is performed on the board. The mask is manufactured in accordance with the board, and thus it is necessary to replace the mask when the board as a printing target is changed. In general, the mask is often manually replaced by an operator. However, recently, there has been known a printing apparatus in which masks for replacement are provided in a stocker and an appropriate mask is picked up from the stocker during replacement of mask and is automatically provided to a printing-job performing position (for example, Japanese Patent No. 2861332 (PTL 1)).

SUMMARY

A screen printing apparatus of the present disclosure performs printing paste on a board via a mask positioned at the printing-job performing position and causes a moving mechanism to position a used mask at a mask shelter position such that it is possible to pick up the mask positioned at the mask shelter position from a mask picking-up opening.

The screen printing apparatus includes an inspection region setter and an operation stop controller.

The inspection region setter sets an inspection region in an inspection plane that intersects with a moving path of the mask until the mask positioned at the printing-job performing position moves to the mask shelter position by the moving mechanism.

The operation stop controller stops an operation of the moving mechanism in a case of detecting a foreign object that crosses the inspection region.

The inspection region setter excludes a passing region of the mask from the inspection region while the mask to be positioned at the mask shelter position passes over the inspection plane from the printing-job performing position.

A screen printing method of the present disclosure means a screen printing method executed by the screen printing apparatus that performs printing paste on a board via a mask positioned at the printing-job performing position and causes the moving mechanism to position a used mask at the mask shelter position such that it is possible to pick up the mask positioned at the mask shelter position from a mask picking-up opening.

The screen printing method includes an inspection region setting process and an operation stop process.

In the inspection region setting process, an inspection region is set in an inspection plane that intersects with a moving path of the mask until the mask positioned at the printing-job performing position moves to the mask shelter position by the moving mechanism.

In the inspection region setting process, the passing region of the mask is excluded from the inspection region while the mask to be positioned at the mask shelter position passes over the inspection plane from the printing-job performing position.

In the operation stop process, an operation of the moving mechanism is stopped in a case of detecting a foreign object that crosses the inspection region.

DETAILED DESCRIPTION

In the related art, in a printing apparatus in which a mask for replacement is automatically mounted, it is necessary to include a stocker in which the mask is stocked, and thus the apparatus is manufactured at high costs. Therefore, there is considered a configuration in which the mask for replacement is inserted from a mask inserting opening provided in a cover member and a used mask is picked up from a mask picking-up opening. However, in this manner, there is a concern that an operator will encounter an unsafe state in a case where the operator picks up the used mask during a printing job, and thus there is a concern that work efficiency will decrease.

Figure 1:
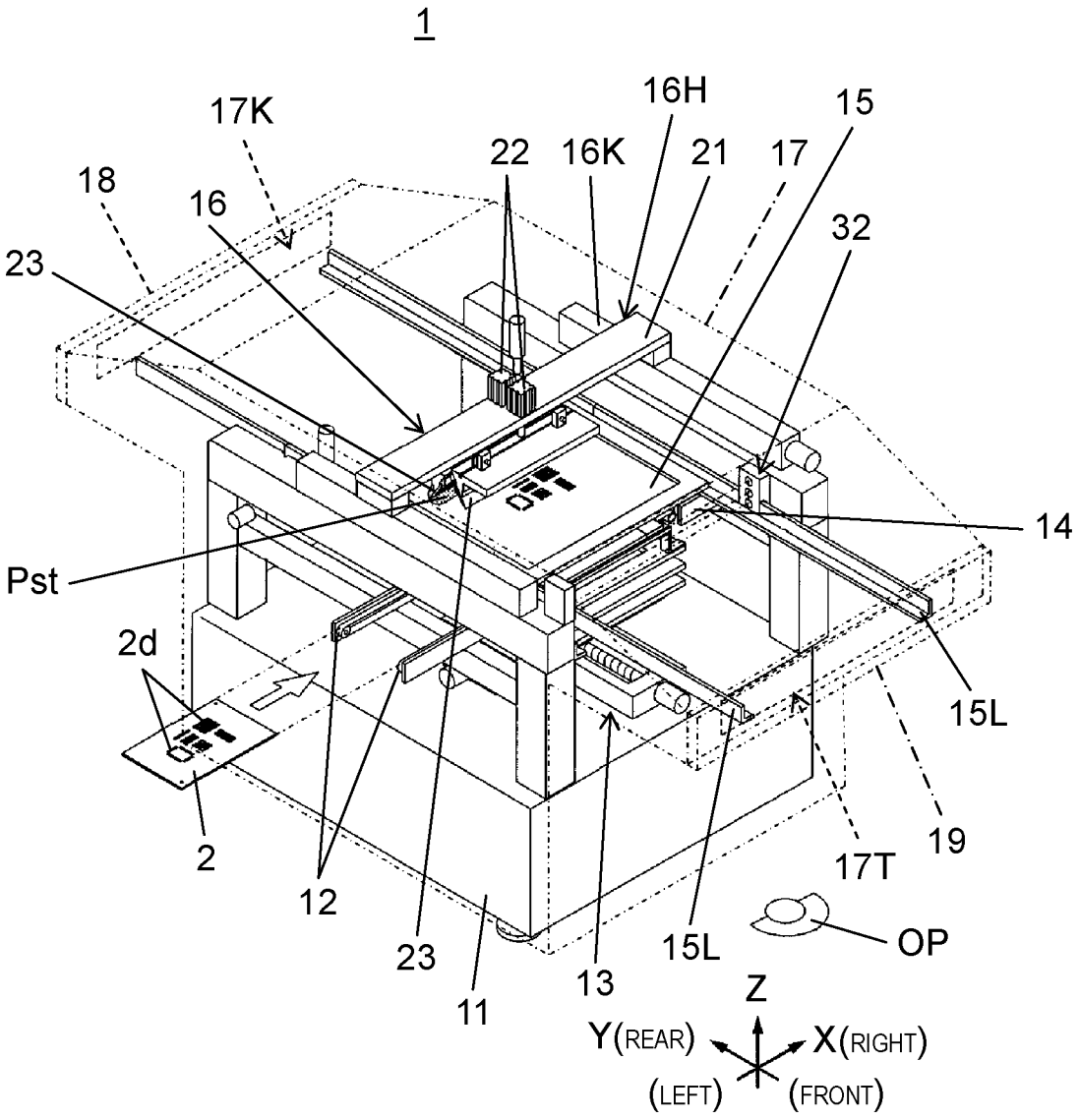
FIG. 1 is a perspective view of a screen printing apparatus in an exemplary embodiment.
Figure 2:
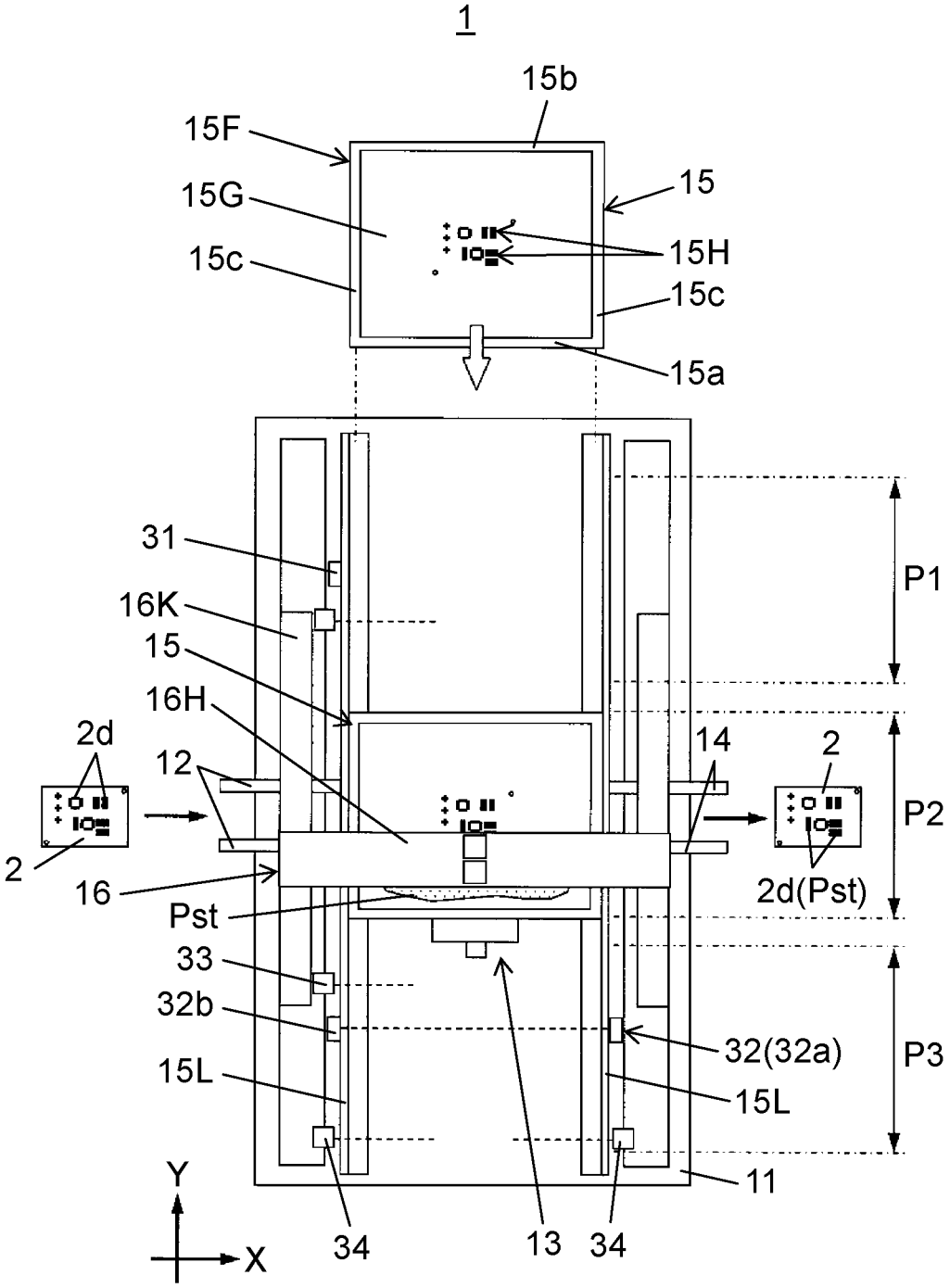
FIG. 2 is a plan view of the screen printing apparatus in the exemplary embodiment.
Figure 3:
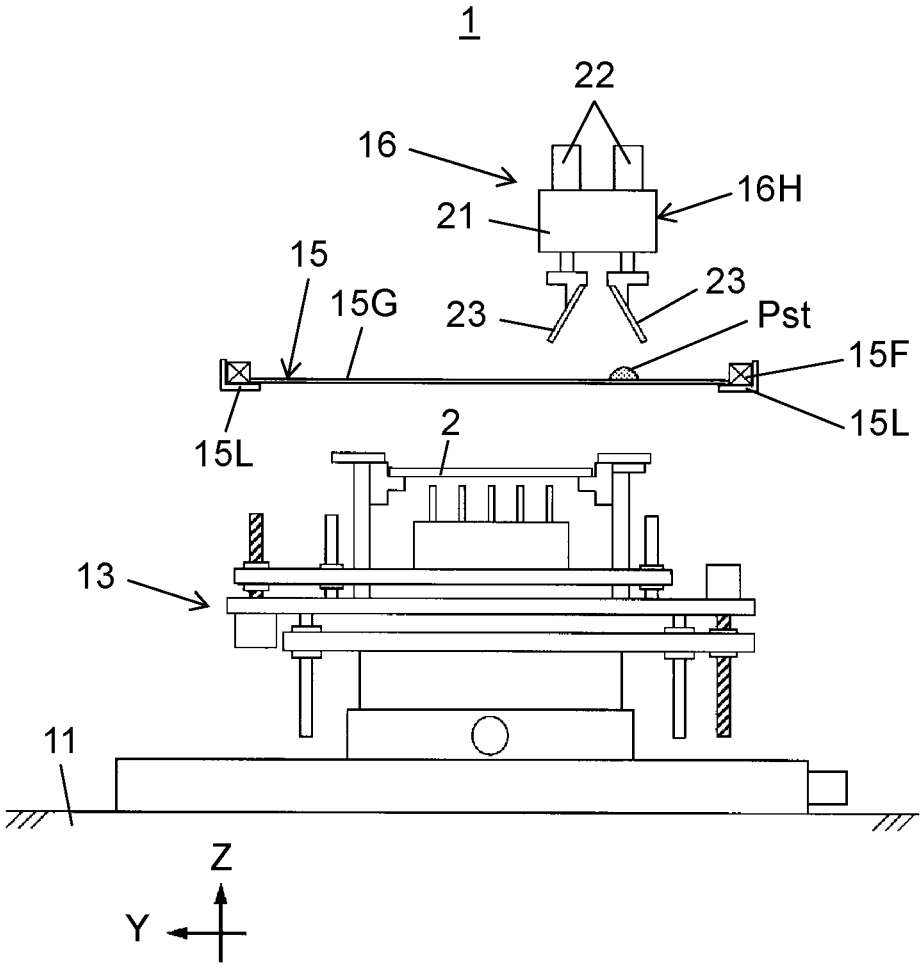
FIG. 3 is a partial side view of the screen printing apparatus in the exemplary embodiment.

Hereinafter, an exemplary embodiment of the present disclosure will be described with reference to the figures. FIGS. 1, 2, and 3 illustrate screen printing apparatus 1 in the exemplary embodiment of the present disclosure. Screen printing apparatus 1 loads board 2 supplied from a side of an upstream process, performs printing paste Pst such as solder on electrode 2*d* provided on a surface of board 2, and unloads the board to a side of a downstream process. Here, for the convenience of description, a rightward-leftward direction of screen printing apparatus 1 viewed from operator OP is referred to as an X-axis direction, a left side is referred to as the side of the upstream process, and a right side is referred to as the side of the downstream process. In addition, a frontward-rearward direction of screen printing apparatus 1 viewed from operator OP is referred to as a Y-axis direction, a close side viewed from operator OP is referred to as a front side, and a deep side viewed from operator OP is referred to as a rear side. Further, an upward-downward direction of screen printing apparatus 1 is referred to as a Z-axis direction.

Figure 4:
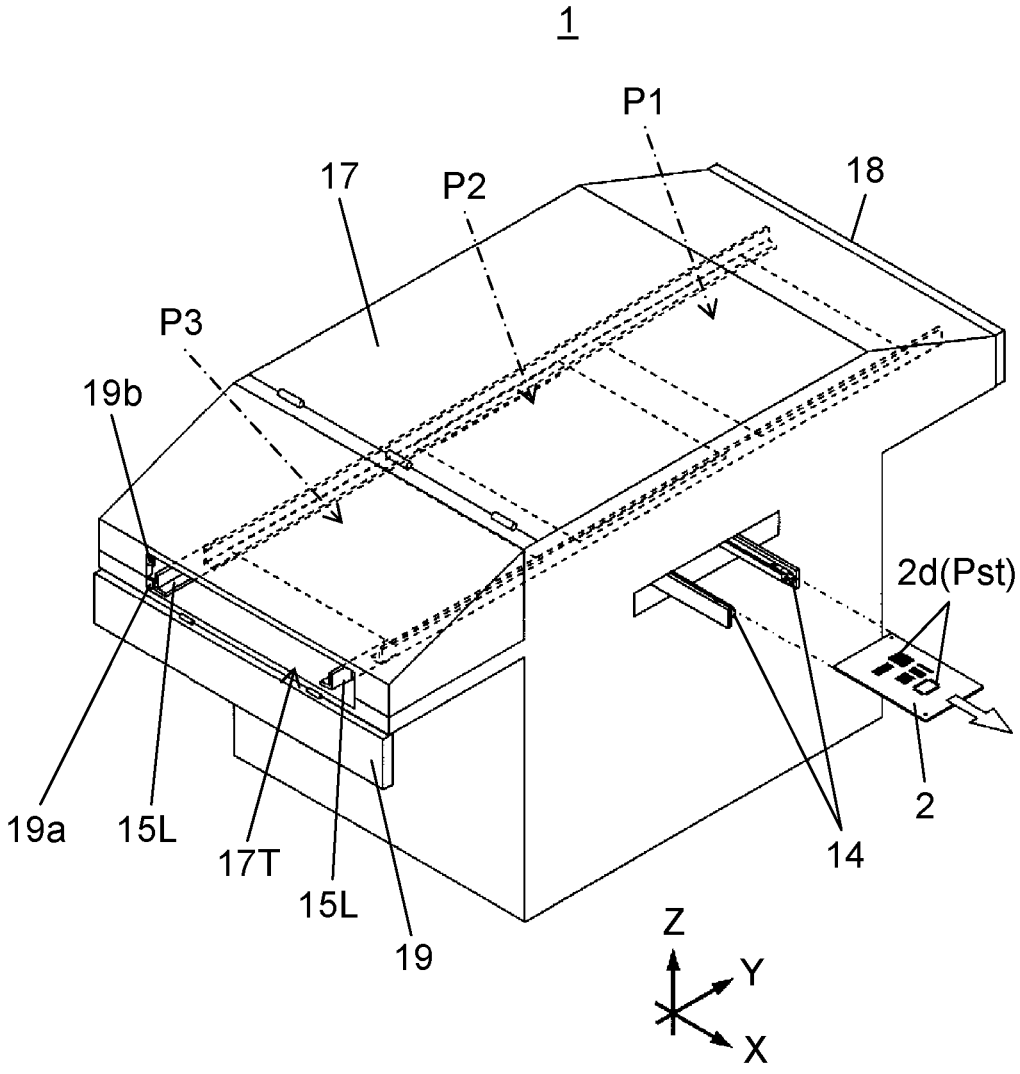
FIG. 4 is a perspective view of the screen printing apparatus in the exemplary embodiment.

In FIGS. 1, 2, and 3, screen printing apparatus 1 includes loading conveyor 12, board holding/moving mechanism 13, and unloading conveyor 14 on base stand 11. Mask 15 and squeegeeing mechanism 16 are provided above board holding/moving mechanism 13. Base stand 11 and equipment described above provided on base stand 11 are covered with cover member 17 (FIGS. 1 and 4).

In FIG. 1, board holding/moving mechanism 13 is provided at the central portion of base stand 11. Board holding/moving mechanism 13 has a function of holding board 2 and a function of lifting and lowering board 2. Loading conveyor 12 loads board 2 fed from the outside and delivers the board to board holding/moving mechanism 13. Unloading conveyor 14 unloads, to the outside, board 2 received from board holding/moving mechanism 13.

In FIGS. 2 and 3, mask 15 is provided with mask main body 15G made of a metal plate-like member and rectangular mask frame 15F that supports the perimeter of mask main body 15G. A plurality of pattern openings 15H disposed to correspond to electrode 2*d* of board 2 are provided at the central portion of mask main body 15G (FIGS. 2 and 5).

Figure 5:
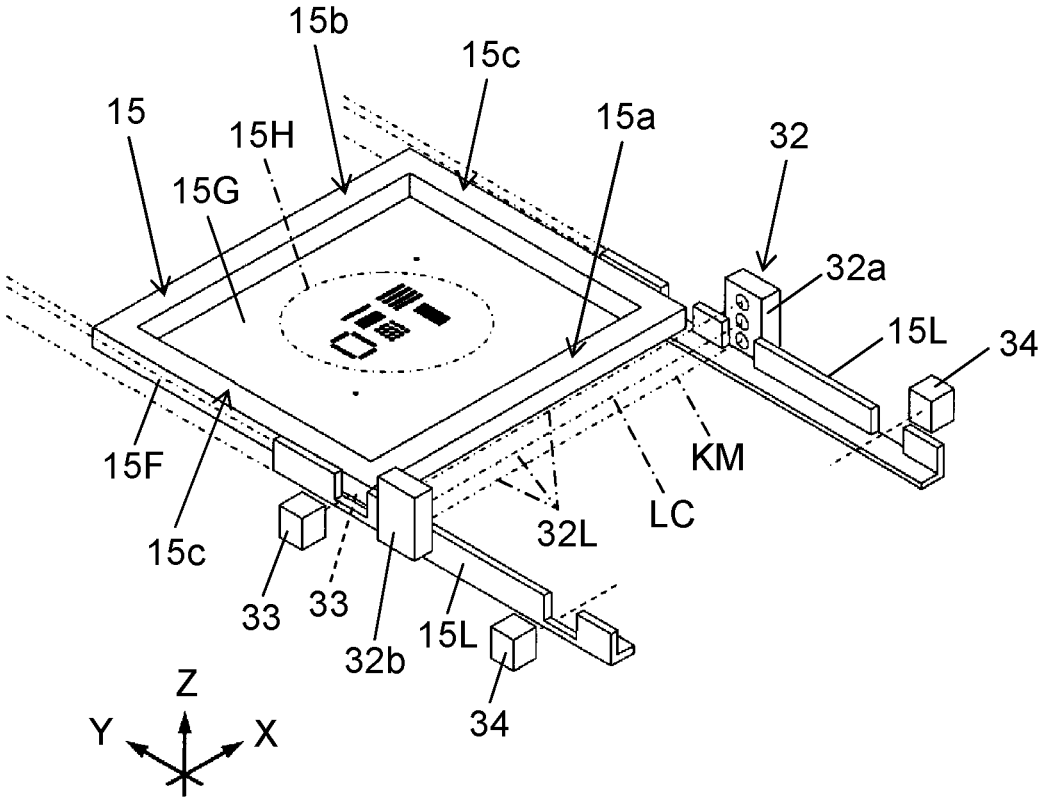
FIG. 5 is a partial perspective view of a front part of a mask guide provided in the screen printing apparatus in the exemplary embodiment.

In FIGS. 2 and 5, mask frame 15F is provided with a pair of cross frames (front cross frame 15*a* and rear cross frame 15*b*) extending in the X-axis direction and a pair of perpendicular frames 15*c* extending in the Y-axis direction. Front cross frame 15*a* is positioned in the front of mask main body 15G. Rear cross frame 15*b* is positioned in the rear of mask main body 15G. The pair of perpendicular frames 15*c* is positioned on both sides of mask main body 15G.

In FIGS. 1 and 2, squeegeeing mechanism 16 includes print head 16H and print head moving mechanism 16K. As illustrated in FIGS. 1 and 3, print head 16H includes a moving base 21 extending in the X-axis direction and two front and rear squeegees 23 that are lifted and lowered by two squeegee lifting/lowering cylinders 22 provided on the moving base 21. Print head 16H is driven by print head moving mechanism 16K and moves in the Y-axis direction.

In FIGS. 1, 2, and 3, a pair of mask guides 15L disposed right and left above the base stand 11 is provided in the Y-axis direction (that is, a horizontal direction). An interval between the pair of mask guides 15L in the X-axis direction is equal to an interval between two perpendicular frames 15*c* of mask frame 15F. The pair of mask guides 15L has a length to the extent that three masks 15 are mounted in the Y-axis direction and is provided with mask standby position P1, printing-job performing position P2, and mask shelter position P3 in this order from a side of a rear end (that is, one end) (FIGS. 2 and 4).

In FIGS. 1 and 4, the pair of mask guides 15L is covered with cover member 17. A rear portion of cover member 17 is provided with mask inserting opening 17K that is open to a side of mask standby position P1 of mask guides 15L. Opening and closing of mask inserting opening 17K are performed by tear door 18 provided in a rear portion of cover member 17. When rear door 18 oscillates down and is in an opened state, operator OP can insert mask 15 through mask inserting opening 17K to mask standby position P1.

A front portion of cover member 17 is provided with mask picking-up opening 17T that is open to a side of mask shelter position P3 of mask guides 15L. Opening and closing of mask picking-up opening 17T are performed by front door 19 provided in a front portion of cover member 17. Each of rear door 18 and front door 19 can oscillate down and be opened.

In the exemplary embodiment, a configuration in which mask 15 is inserted from the rear side of screen printing apparatus 1, and mask 15 is picked up from the front side of screen printing apparatus 1 is described. However, screen printing apparatus 1 may employ another configuration. In addition, the exemplary embodiment employs a configuration in which rear door 18 and front door 19 oscillate down and are opened, but the exemplary embodiment may employ a configuration in which the doors are opened up. However, from a viewpoint of maintaining a stably opened state during insertion of the mask, it is desirable to employ the configuration in which the door is opened down.

When rear door 18 oscillates down and is in an opened state (FIG. 4), operator OP can insert mask 15 through mask inserting opening 17K into a rear end portion of the pair of mask guides 15L. When operator OP mounts mask 15 at mask standby position P1, the operator mounts both ends of front cross frame 15*a* of mask 15 in a horizontal posture on the pair of mask guides 15L and pushes rear cross frame 15*b* of mask 15 to the front side.

As will be described below, squeegeeing mechanism 16 as a moving mechanism moves (mounts) mask 15 pushed to mask standby position P1 to printing-job performing position P2 at the central portion on mask guide 15L. After a printing job is finished by using mask 15, mask 15 mounted at printing-job performing position P2 is moved (sheltered) as used mask 15 to mask shelter position P3 by squeegeeing mechanism 16 and is picked up by operator OP.

In the movement of mask 15 on mask guides 15L, a region between mask standby position P1 and printing-job performing position P2 on mask guides 15L functions as a moving route of mask 15 for mounting mask 15 at printing-job performing position P2. In addition, a region between printing-job performing position P2 and mask shelter position P3 on mask guides 15L functions as a moving route of mask 15 for picking up (sheltering) mask 15 from printing-job performing position P2.

In FIG. 4 a front end portion of cover member 17 is provided with front-door sensor 19*a* (opened/closed state detector) and front-door locking mechanism 19*b* (locking mechanism). Front-door sensor 19*a* detects an opened/closed state of front door 19 with respect to mask inserting opening 17T. Front door 19 blocks mask picking-up opening 17T. Front-door locking mechanism 19*b* mechanically locks front door 19 into a closed state and also unlocks the front door. Here, front-door locking mechanism 19*b* is configured to mechanically lock front door 19; however, the front-door locking mechanism may not be configured to perform mechanical locking. However, in a case other than cases where mask 15 is prevented from jumping out and is picked up, it is desirable that the mechanical locking is employed in order to prevent a hand of operator OP from entering from mask picking-up opening 17T.

In FIG. 2, screen printing apparatus 1 includes mask detecting sensor 31 at a position corresponding to the front side of front cross frame 15*a* of mask 15 in a state of being positioned at mask standby position P1. Mask detecting sensor 31 projects inspection light in the X-axis direction (direction toward the side of the central portion of base stand 11) and receives reflected light of the inspection light reflected from a side surface of perpendicular frame 15*c* of mask frame 15F. Therefore, mask detecting sensor 31 detects a timing when switching is performed from a state in which the reflected light is not received to that time to a state in which the reflected light is received, thereby making it possible to detect that mask 15 pushed by operator OP reaches mask standby position P1.

In FIGS. 2 and 5, inspection region setters 32, internal sensor 33, and external sensors 34 are provided in a region on a front side (side of mask shelter position P3) from printing-job performing position P2 on mask guide 15L. In the exemplary embodiment, each of internal sensor 33 and external sensors 34 is configured as a non-contact light sensor with respect to mask 15 moved on mask guide 15L by squeegeeing mechanism 16 as a moving mechanism.

In FIGS. 2 and 5, inspection region setters 32 are provided at positions interposing two mask guides 15L in the X-axial direction on a moving path of mask 15 moved from printing-job performing position P2 to mask shelter position P3. Inspection region setter 32 is provided with light projector 32*a* and light receiver 32*b*. Light projector 32*a* is configured of a plurality of light projecting units aligned in an upward-downward direction, which project inspection light 32L (FIG. 5) in the X-axis direction. Light receiver 32*b* is configured of a plurality of light receiving units aligned in the upward-downward direction, which receive inspection light 32L projected from the light projecting units. The inspection light 32L projected from the light projector 32*a* forms an inspection light curtain formed by a plurality of aligned parallel beams of inspection light in inspection plane KM parallel to a plane (here, an XZ plane) intersecting with the moving path of mask 15 moving from printing-job performing position P2 to mask shelter position P3, and inspection light 32L sets inspection region LC (FIG. 5).

Inspection region setter 32 is set not to receive inspection light 32L projected from light projector 32*a* corresponding to some of the plurality of light receiving units provided in light receiver 32*b*, thereby making it possible to temporarily form an invalid area in the inspection light curtain. In this manner, it is possible to exclude a passing region of mask 15 from the inspection region LC, and thus it is not possible for light receiver 32*b* to detect mask 15. It is desirable to use light receiver 32*b* and light projector 32*a* having a malfunction detecting function. If malfunction is detected, it is desirable to enter into a light blocking state. A distance between light receiving units which are vertically adjacent to each other is appropriately set depending on a dimension of mask 15 that is used, a dimension between mask inserting opening 17K and inspection region LC, or the like.

In FIGS. 2 and 5, internal sensor 33 is provided at a position on a slightly rear side of the inspection light curtain formed by inspection region setters 32. Internal sensor 33 projects inspection light in the X-axis direction (direction toward the side of the central portion of base stand 11) and receives reflected light of the inspection light reflected from a side surface of perpendicular frame 15*c* of mask frame 15F. Internal sensor 33 detects a timing when switching is performed from a state in which the reflected light is not received to that time to a state in which the reflected light is received, thereby making it possible to detect a state in which mask 15 starts crossing inspection plane KM. In the exemplary embodiment, internal sensor 33 functions as a first detector that detects a state in which mask 15 moving from printing-job performing position P2 to mask shelter position P3 by squeegeeing mechanism 16 starts crossing inspection plane KM.

In FIGS. 2 and 5, two external sensors 34 are provided at positions corresponding to both sides of front cross frame 15*a* of mask 15 in a state of being positioned at mask shelter position P3. Each of external sensors 34 projects inspection light in the X-axis direction (direction toward the side of the central portion of base stand 11) and receives reflected light of the inspection light reflected from a side surface of perpendicular frame 15*c* of mask frame 15F. Therefore, two external sensor 34 are capable of simultaneously detecting a state in which mask 15 positioned at mask shelter position P3 based on the switching from the state in which the reflected light is not received to that time to the state in which the reflected light is received. In the exemplary embodiment, external sensor 34 functions as a detector (third detector) that detects that mask 15 moved from printing-job performing position P2 to mask shelter position P3 by squeegeeing mechanism 16 reaches mask shelter position P3.

In addition, external sensor 34 detects a timing when switching is performed from a state in which the reflected light is received to that time to a state in which the reflected light is not received, thereby making it possible to detect a state in which mask 15 positioned at mask shelter position P3 is pulled out from mask guide 15L and also making it possible to detect a state in which mask 15 finishes crossing inspection plane KM. In the exemplary embodiment, external sensor 34 functions as a detector (second detector) that detects a state in which mask 15 moved from printing-job performing position P2 to mask shelter position P3 by squeegeeing mechanism 16 finishes crossing inspection plane KM.

In a case where external sensors 34 are disposed at both side surfaces and receive reflected light, false detection of receiving projected light from each other as reflected light needs to be prevented. For example, wavelengths of projected light are different, timing of projecting light is shifted in time, or the like. In this manner, false detection is prevented. In addition, an example in which external sensors 34 are disposed on the right and left one by one is described; however, for example, thereby may be employed a configuration in which one external sensor is disposed on a diagonal side of internal sensor 33. In addition, an example in which one internal sensor 33 is disposed is described; however, the configuration is not limited to one internal sensor 33 and another internal sensor may be disposed on the opposite side as long as internal sensor 33 may be capable of detecting mask 15 before inspection region setters 32 performs the detection.

Figure 6:
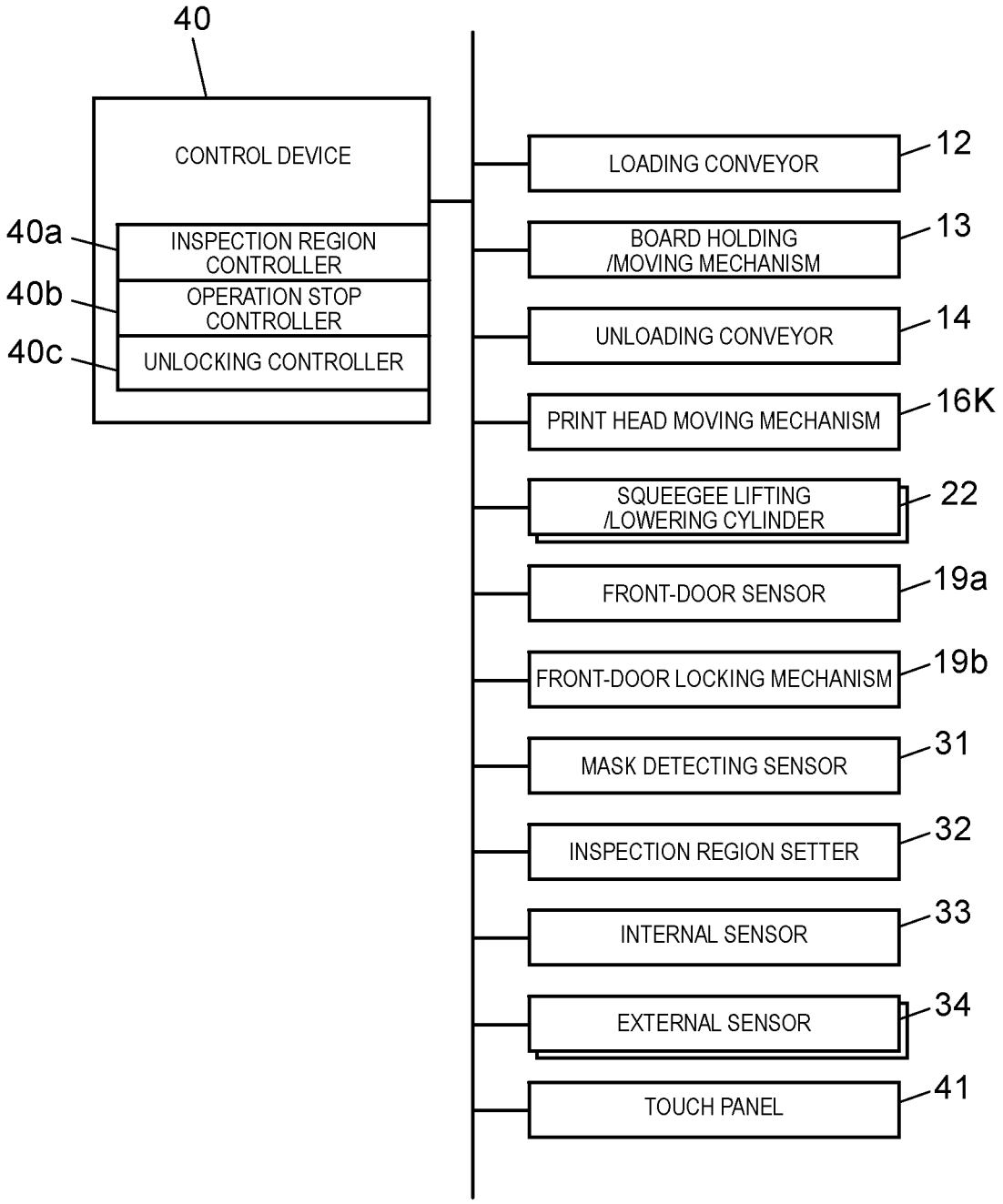
FIG. 6 is a block diagram illustrating a control system of the screen printing apparatus in the exemplary embodiment.

In FIG. 6, control device 40 provided in screen printing apparatus 1 controls a loading operation of board 2 by loading conveyor 12, a holding and moving operation of board 2 by board holding/moving mechanism 13, and an unloading operation of board 2 by unloading conveyor 14. In addition, control device 40 controls a moving operation of print head 16H by print head moving mechanism 16K, a lifting/lowering operation of squeegee 23 by squeegee lifting/lowering cylinder 22, a setting operation of inspection region LC by inspection region setter 32, and locking and unlocking of front door 19 by front-door locking mechanism 19*b*. Detection information of the opened/closed state of front door 19 by front-door sensor 19*a* is input to control device 40, and control device 40 detects the opened/closed state of front door 19 based on the detection information.

Detection information of mask detecting sensor 31, internal sensor 33, external sensor 34 is input to control device 40. Control device 40 detects a state in which mask 15 inserted from mask inserting opening 17K reaches mask standby position P1, based on the detection information from mask detecting sensor 31. In addition, control device 40 detects a state in which a leading portion of mask 15 moved from printing-job performing position P2 to mask shelter position P3 crosses the inspection region by inspection light of internal sensor 33 (detection of a state in which mask 15 starts crossing inspection plane KM), based on the detection information from internal sensor 33. In addition, control device 40 detects a state in which a tail portion of mask 15 moved from printing-job performing position P2 to mask shelter position P3 crosses the inspection region by inspection light of external sensor 34 (a state in which mask 15 is pulled out from mask guide 15L or a state in which mask 15 finishes crossing inspection plane KM), based on the detection information from external sensor 34. Further, control device 40 detects a state in which the leading portion of mask 15 crosses the inspection region by the inspection light of external sensors 34 (a state in which mask 15 is positioned at mask shelter position P3).

In FIG. 6, control device 40 includes inspection region controller 40*a*, operation stop controller 40*b*, and unlocking controller 40*c*. Inspection region controller 40*a* controls an operation of inspection region setters 32.

Inspection region controller 40*a* controls inspection region setter 32 such that some of the plurality of light receiving units provided in light receiver 32*b* are set not to receive inspection light 32L, and thereby it is possible to temporarily form an invalid area in the inspection light curtain. In other words, muting (invalidation) of excluding the passing region of mask 15 from inspection region LC is performed. In this manner, it is possible to exclude the passing region of mask 15 from inspection region LC in inspection plane KM while mask 15 moved from printing-job performing position P2 to mask shelter position P3 by squeegeeing mechanism 16 crosses inspection plane KM.

Operation stop controller 40*b* of control device 40 stops an operation of a predetermined operating mechanism in a case of detecting an inserted object inserted from mask picking-up opening 17T which crosses inspection region LC set by inspection region setter 32. Here, the "predetermined operating mechanism", specifically, means a mechanism that may be brought into contact with a foreign object, of operating mechanisms positioned in a rear region from inspection plane KM in a case where the foreign object (for example, a hand of operator OP) is inserted from mask picking-up opening 17T. Specifically, in the exemplary embodiment, the operating mechanism corresponds to the predetermined operating mechanism including squeegeeing mechanism 16 (squeegeeing mechanism 16 and operating mechanisms related to the squeegeeing mechanism) and stops the printing operation.

Unlocking controller 40*c* of control device 40 controls an unlocking operation of front door 19 by front-door locking mechanism 19*b* after external sensor 34 as the third detector detects that mask 15 reaches mask shelter position P3.

In FIG. 6, touch panel 41 as an input/output device is connected to control device 40. Touch panel 41 functions as an input device on which operator OP performs a predetermined input to control device 40. Further, touch panel 41 functions as an output device on which control device 40 displays a state of screen printing apparatus 1 to operator OP or gives an operation instruction to operator OP.

In order to mount mask 15 at printing-job performing position P2, first, operator OP moves the mask to a rear position of the base stand 11 from a front position of the base stand 11, and then rear door 18 oscillates down to be in an opened state. Operator OP inserts mask 15 from one end side (rear end side) of mask guide 15L (arrow P in (a) of FIG. 7) and positions mask 15 at mask standby position P1. Since operator OP positions mask 15 at mask standby position P1, rear door 18 oscillates up so as to be in the closed door state. When rear door 18 is in the opened state, control device 40 forms inspection plane KM in a plane intersecting with moving path of mask 15 when mask 15 is moved from printing-job performing position P2 to mask shelter position P3 by squeegeeing mechanism 16 (inspection light curtain forming process).

When mask 15 is positioned at mask standby position P1, mask detecting sensor 31 detects the positioning of the mask. When a timing to move mask 15 to printing-job performing position P2 comes in a state in which control device 40 detects a state in which mask 15 is positioned at mask standby position P1 and rear door 18 is in the closed state, control device 40 moves mask 15 positioned at mask standby position P1 to printing-job performing position P2.

Control device 40 performs a moving operation of mask 15 when internal sensor 33 and external sensors 34 detect that mask 15 is not mounted at mask shelter position P3. For example, if mask 15 is already present (sheltered) at mask shelter position P3 in (a) of FIG. 7, it is not possible to move mask 15 positioned at printing-job performing position P2 to mask shelter position P3. Therefore, control device 40 notifies operator OP, through touch panel 41, that mask 15 is present at mask shelter position P3 and thus it is not possible to transport mask 15.

Figure 7:
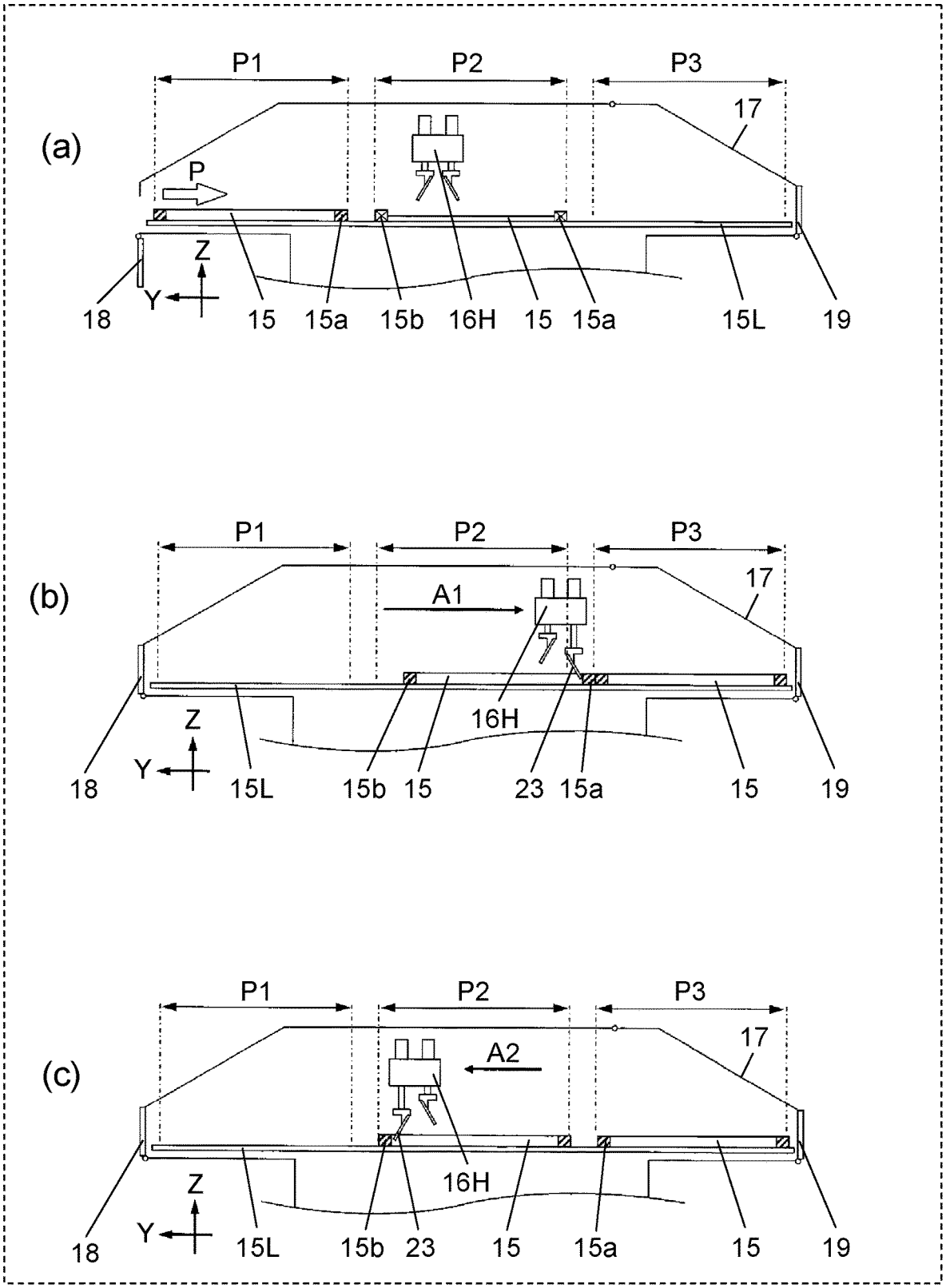
FIG. 7 is a partial side view illustrating a procedure of mounting the mask by the screen printing apparatus in the exemplary embodiment.

When mask 15 is moved to printing-job performing position P2, control device 40 pushes front cross frame 15*a* of mask 15 positioned at mask standby position P1 to the front side (arrow A1 in (b) of FIG. 7) by squeegee 23. In a case where mask 15 (used mask 15) is already positioned at printing-job performing position P2, the control device causes the used mask 15 to be also pushed together to the front side and causes the used mask 15 to be positioned at mask shelter position P3 ((b) of FIG. 7). Since used mask 15 is positioned at mask shelter position P3, mask 15 that is to be mounted at printing-job performing position P2 is caused to slightly return to the rear side (arrow A2 in (c) of FIG. 7) by squeegee 23, and positioning is accurately performed ((c) of FIG. 7). As will be described below, in a state in which used mask 15 is moved to mask shelter position P3, operator OP causes front door 19 to be in the opened state, and then it is possible to pick up used mask 15 from the front end side (the other end side) of mask guide 15L.

Figure 8:
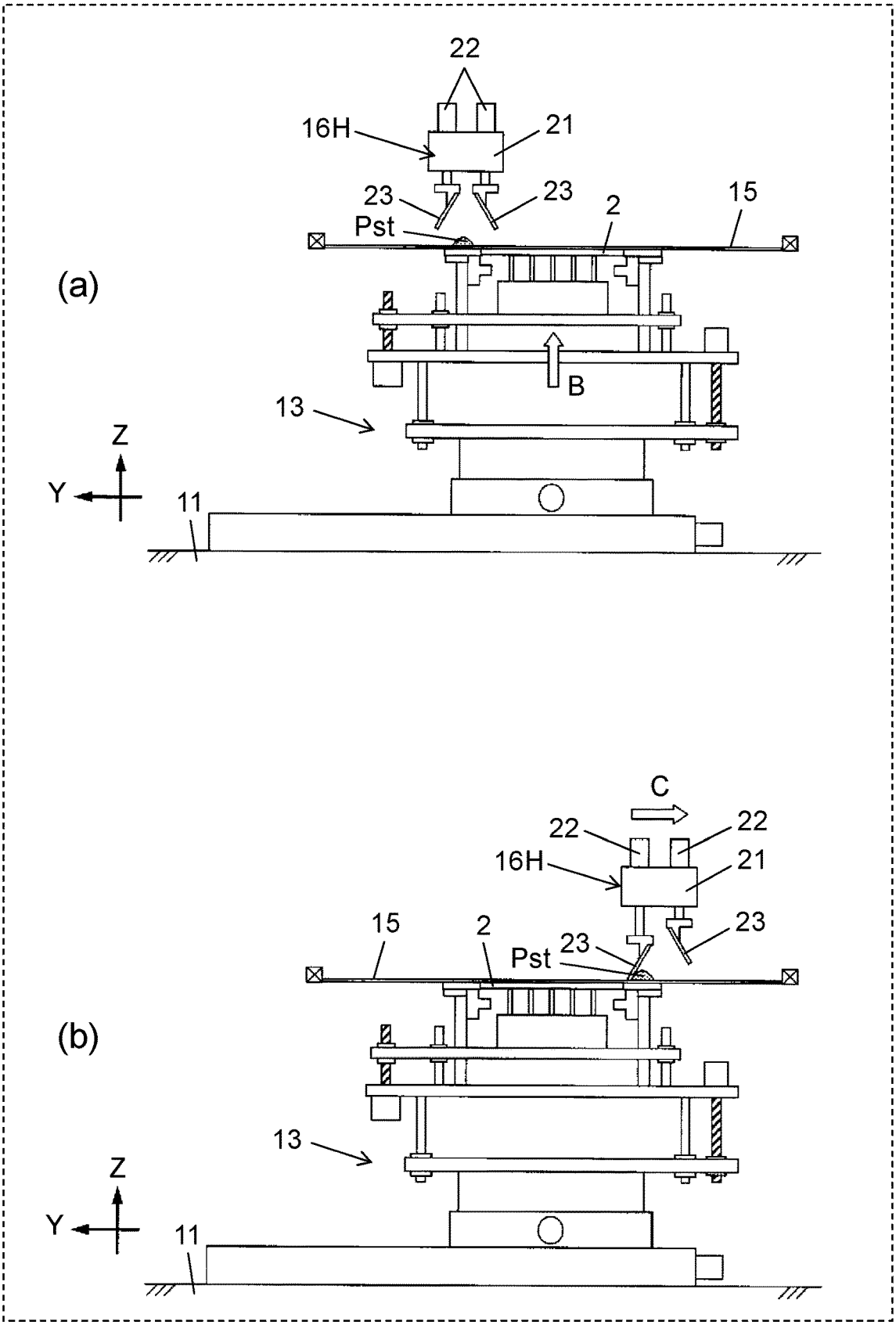
FIG. 8 is a partial side view illustrating an operation of the screen printing apparatus in the exemplary embodiment.

When screen printing apparatus 1 performs the screen printing job, the lower surface of mask 15 mounted at printing-job performing position P2 as described above approaches substrate 2 to the extent that the lower surface is almost in contact with the substrate (arrow B in (a) of FIG. 8), then squeegee 23 is lowered to abut on mask main body 15G by squeegee lifting/lowering cylinder 22, and print head 16H is horizontally (Y-axis direction) moved (arrow C in (b) of FIG. 8). In this manner, squeegee 23 slides on mask main body 15G, paste Pst is scraped on mask main body 15G, and paste Pst is applied on electrode 2*d* of board 2 via pattern openings 15H. In other words, squeegeeing mechanism 16 (moving mechanism) has a function of performing printing on board 2 under mask 15 with paste Pst on mask 15 by squeegee 23. When paste Pst is applied on electrode 2*d* of board 2, board 2 is lowered to be separated from mask 15 (plate releasing), and unloading conveyor 14 unloads board 2 to a side of the downstream process.

Figure 9:
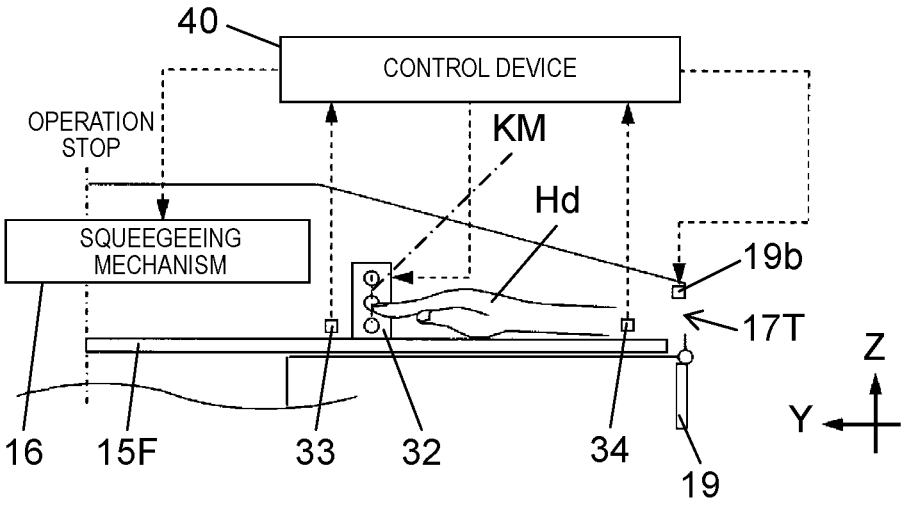
FIG. 9 is a partial side view illustrating a state in which an operator's hand is inserted from a mask picking-up opening of the screen printing apparatus in the exemplary embodiment.

Here, in a state in which used mask 15 is positioned at mask shelter position P3, operator OP causes front door 19 to be in the opened state and can pick up used mask 15 positioned at mask shelter position P3 even when screen printing job is performed. After operator OP picks up used mask 15 from mask picking-up opening 17T, mask picking-up opening 17T come into a state in which a hand can be inserted deep therethrough. Even in this state, operator OP does not need to insert his or her hand from mask picking-up opening 17T. However, in a case where operator OP inserts his or her hand from mask picking-up opening 17T in order to take some action, a part of inspection plane KM is blocked from light by hand Hd of operator OP when a tip of the hand passes over inspection plane KM (FIG. 9). Then, since operation stop controller 40*b* of control device 40 performs control of stopping the operation of the predetermined operating mechanism including squeegeeing mechanism 16 (operation stop process), the hand of operator OP does not touch the operating mechanism during movement and thus safety of operator OP is achieved.

On the other hand, even in a case where mask 15 disposed at printing-job performing position P2 is moved to mask shelter position P3, mask 15 crosses inspection plane KM. However, in such a case, control device 40 does not stop the operation of the operating mechanism such as squeegeeing mechanism 16 in order not to decrease operation efficiency. Therefore, in such a case, control device 40 performs the following muting and unlocking control of front door 19.

Figure 10:
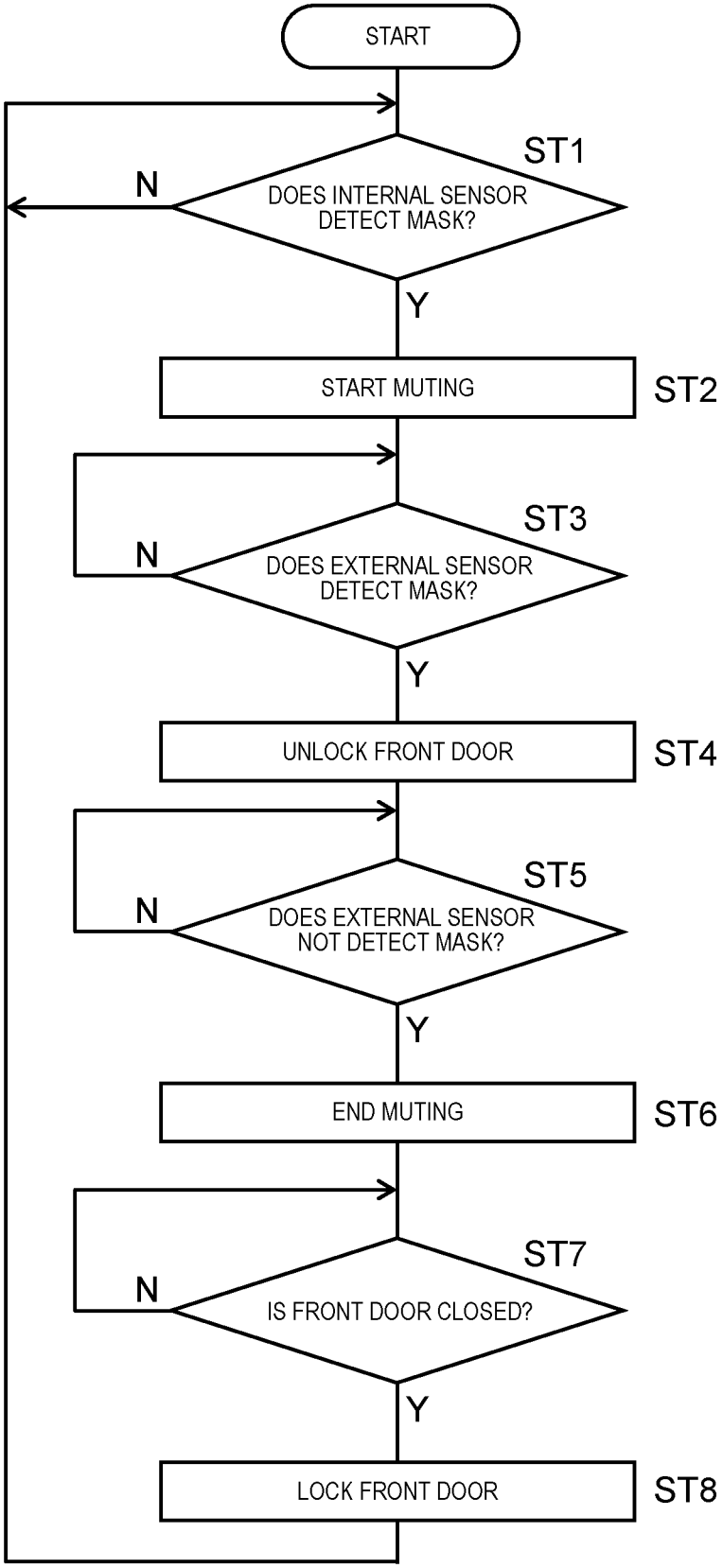
FIG. 10 is a flowchart illustrating flow of muting and unlocking control of a front door performed by a control device of the screen printing apparatus in the exemplary embodiment.
Figure 11:
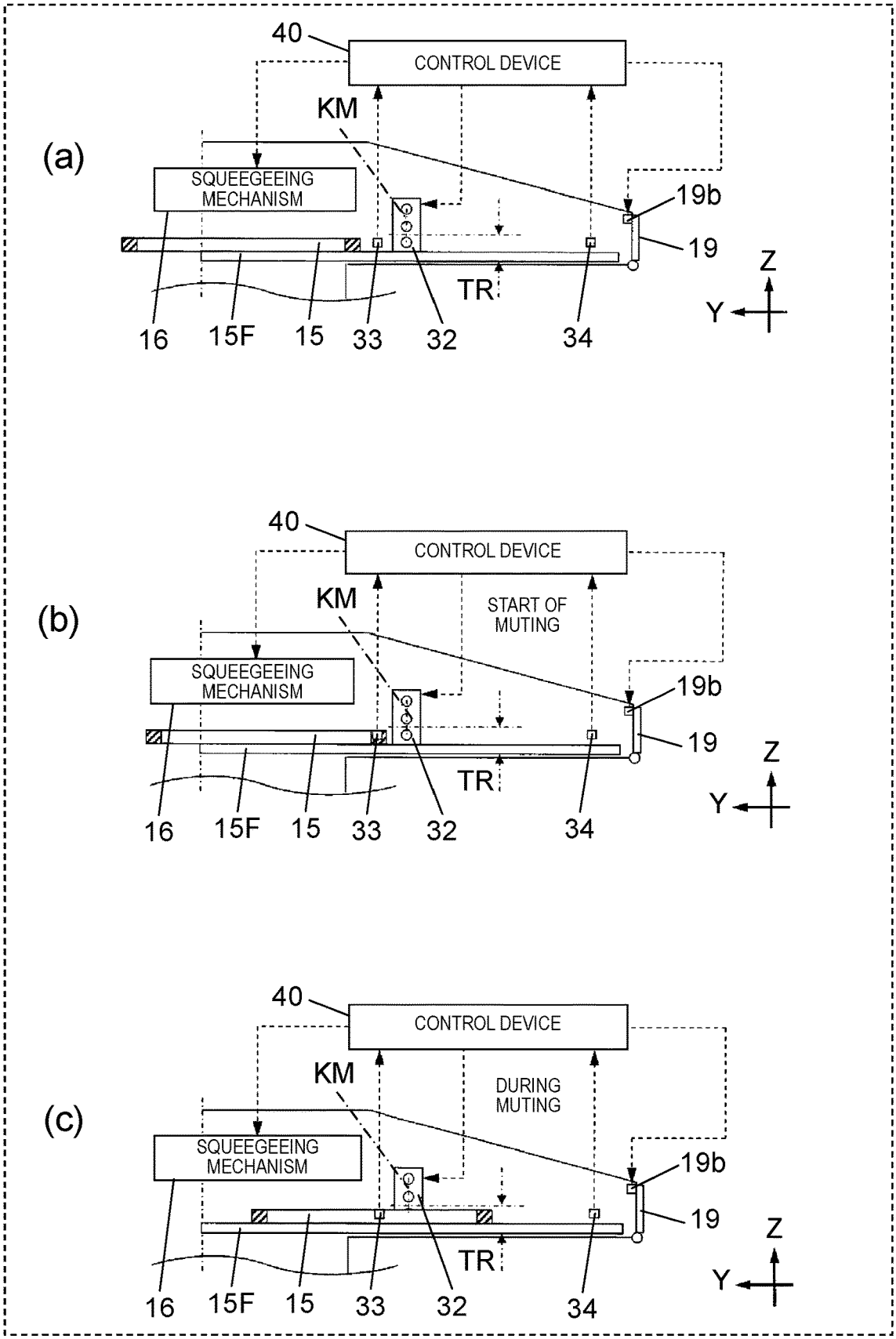
FIG. 11 is a partial side views illustrating a procedure of detecting a mask performed by the screen printing apparatus in the exemplary embodiment.
Figure 12:
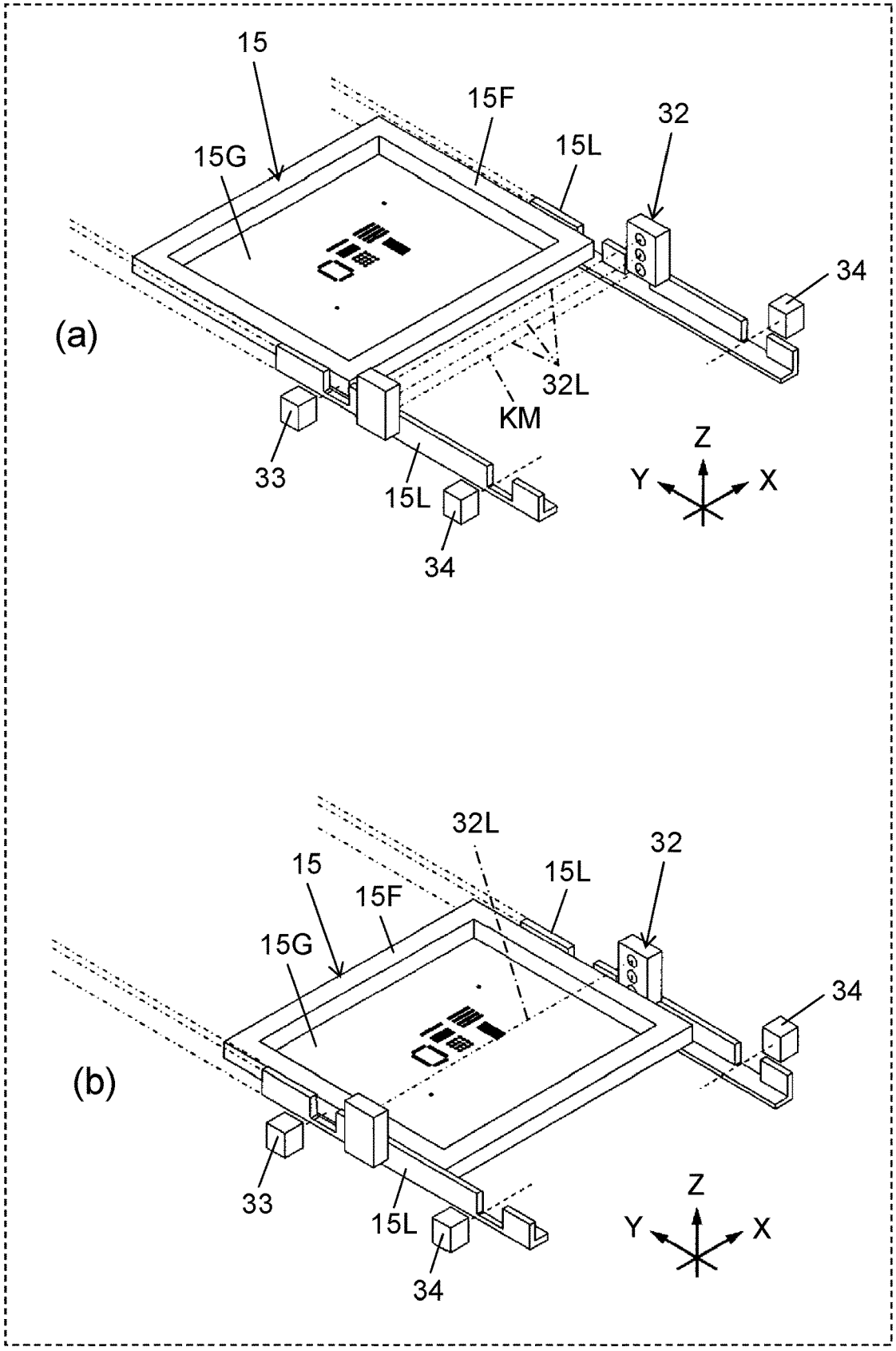
FIG. 12 is a perspective views illustrating the mask guide along with a mask in the exemplary embodiment.

In flowchart of FIG. 10, control device 40 checks that mask 15 is not disposed at mask shelter position P3 and front door 19 is in the closed state, and monitoring whether internal sensor 33 detects mask 15 is started (Step ST1 illustrated in flowchart of FIG. 10, (a) of FIG. 11, and (a) of FIG. 12). In a case where internal sensor 33 detects mask 15 ((b) of FIG. 11), control device 40 determines that mask 15 moving from printing-job performing position P2 to mask shelter position starts crossing inspection plane KM. Then, control device 40 starts the muting of excluding passing region TR ((a), (b), and (c) of FIG. 11) of mask 15 in inspection plane KM from inspection region LC set on inspection plane KM (Step ST2). Specifically, inspection region controller 40*a* controls inspection region setters 32 such that a certain region including a region of mask 15 in a height direction is excluded from inspection region LC.

In a state of performing the muting, control device 40 does not recognize that mask 15 crosses inspection plane KM even when mask 15 crosses inspection plane KM ((c) of FIG. 11 and (b) of FIG. 12). Therefore, control device 40 does not stop the operation of the predetermined operating mechanism even when inspection plane KM is blocked by mask 15. Control device 40 performs a display indicating this on touch panel 41 and calls attention of operator OP to the display while performing the muting. The muting is an unsafe-side action for operator OP but is configured in consideration of safety of operator OP.

After control device 40 starts muting, the control device monitors whether or not external sensors 34 detects mask 15 (Step ST3). In a case where external sensors 34 detects mask 15 ((a) of FIG. 13 and (a) of FIG. 14), unlocking controller 40*c* determines that mask 15 moved from printing-job performing position P2 to mask shelter position P3 reaches mask shelter position P3 and causes front-door locking mechanism 19*b* to unlock front door 19 (Step ST4).

Control device 40 performs a display indicating that the mask reaches the mask shelter position on touch panel 41 when determining that mask 15 reaches mask shelter position P3. In addition, the control device performs a display indicating that the front door is unlocked on touch panel 41 when unlocking front door 19. In this manner, operator OP can know that mask 15 reaches mask shelter position P3 and front door 19 is unlocked. Operator OP opens front door 19, thereby making it possible to pull out and pick up used mask 15 positioned at mask shelter position P3 from mask guide 15L through mask picking-up opening 17T.

Figure 13:
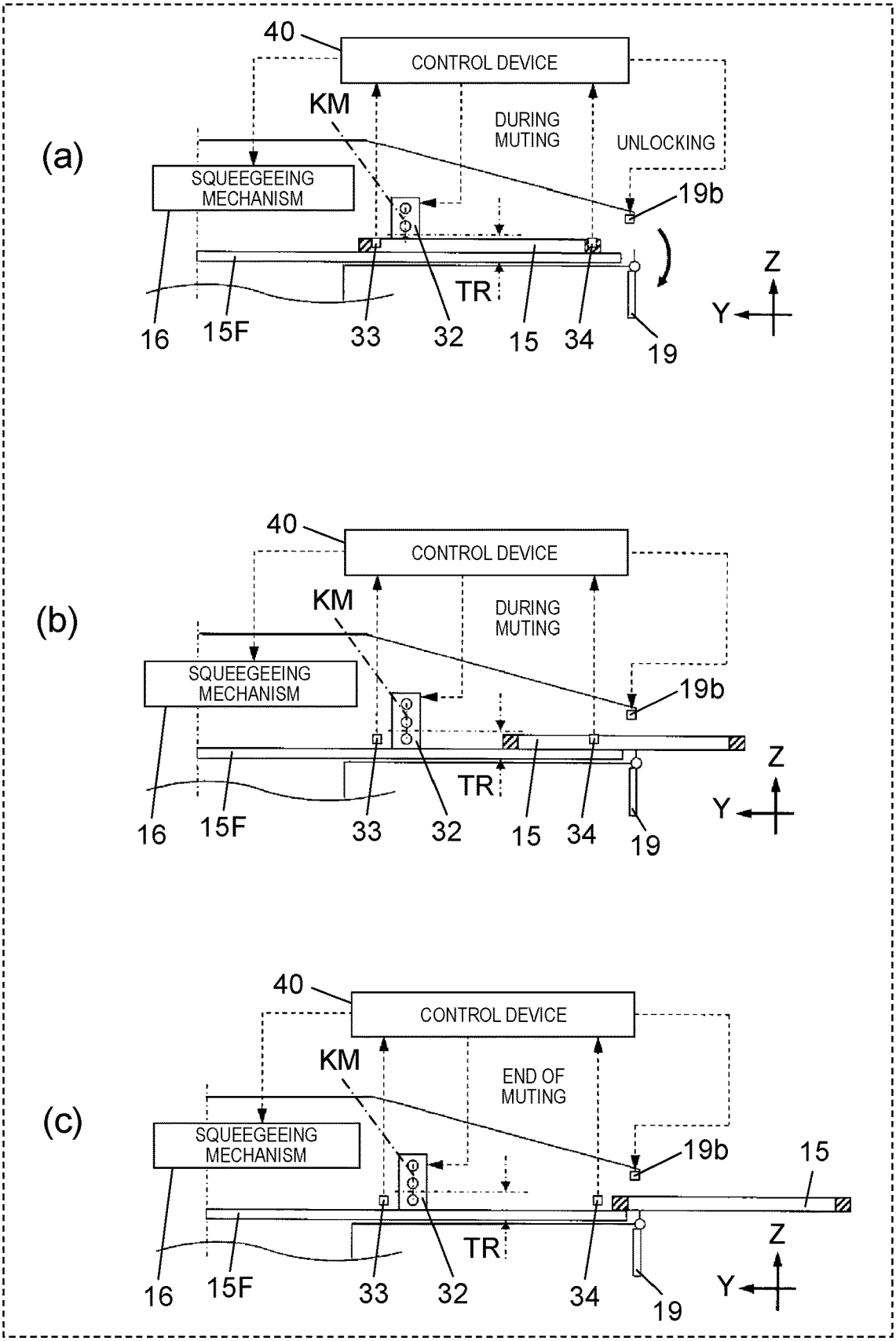
FIG. 13 is a partial side views illustrating the procedure of detecting the mask performed by the screen printing apparatus in the exemplary embodiment.
Figure 14:
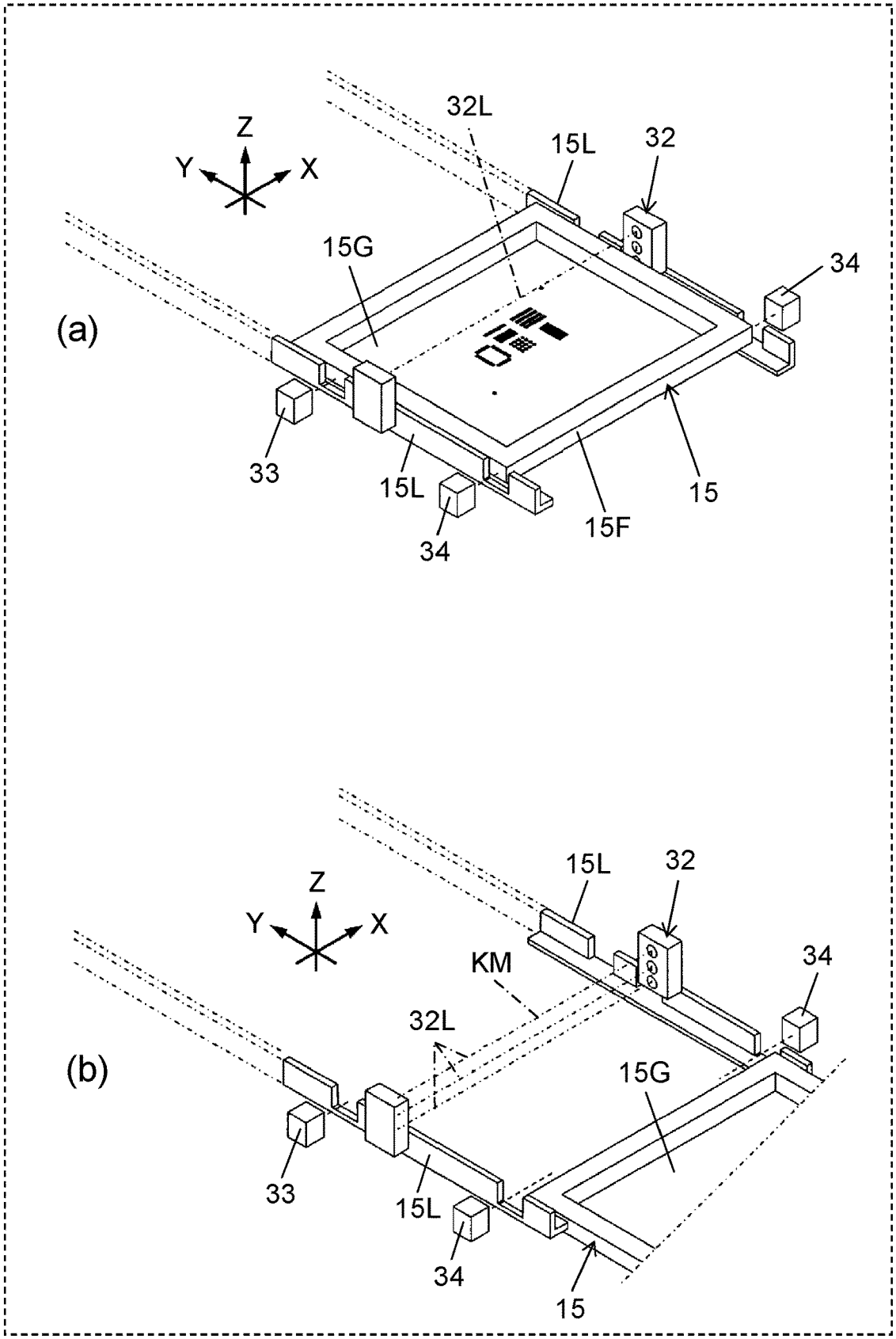
FIG. 14 is a perspective views illustrating the mask guide along with the mask in the exemplary embodiment.

Then, control device 40 monitors whether or not external sensors 34 detects mask 15 (Step ST5 and (b) of FIG. 13). In a case where external sensors 34 does not detect mask 15 ((c) of FIG. 13 and (b) of FIG. 14), the control device determines that mask 15 moved positioned at mask shelter position P3 is picked up by operator OP (mask 15 moved from printing-job performing position P2 to mask shelter position P3 finishes crossing inspection plane KM) and the muting is ended (Step ST6). When the muting is ended, from the viewpoint of safety, control device 40 displays, on touch panel 41, a message of urging operator OP to close front door 19.

As described above, in the exemplary embodiment, inspection region setter 32 excludes passing region TR of mask 15 from inspection region LC between the detection of the state in which mask 15 starts crossing inspection plane KM by internal sensor 33 as the first detector and the detection of the state in which mask 15 finishes crossing inspection plane KM by external sensor 34 as the second detector. As described above, in a process including an operation from the start to the end of the muting performed by inspection region setters 32, inspection region LC is set in inspection plane KM that intersects with the moving path of mask 15 to mask shelter position P3 to which mask 15 positioned at printing-job performing position P2 moves. Further, a process including an operation from the start to the end of the muting is an inspection region setting process of excluding passing region TR of mask 15 from inspection region LC while mask 15 moving from printing-job performing position P2 to mask shelter position P3 passes over inspection plane KM.

After control device 40 ends the muting, the control device monitors whether or not front door 19 is in the closed state based on the detection information from front-door sensor 19*a* (Step ST7). In a case of detecting that front door 19 is in the closed state, control device 40 operates front-door locking mechanism 19*b* such that the front-door locking mechanism locks front door 19 into the closed state Step ST8). Then, a series of control is ended, and the procedure returns to Step ST1.

In the exemplary embodiment, as described above, when detection of mask 15 reaching mask shelter position P3 is performed, front door 19 is unlocked. Then, front door 19 is opened, and mask 15 is picked up from the mask picking-up opening 17T. When front door 19 is closed, front door 19 is locked. In other words, front door 19 as a door member is locked into the closed state except for time between when front door 19 is opened because the detection of mask 15 reaching mask shelter position P3 is performed, and when detection of front door 19 that is closed after mask 15 is picked up from mask picking-up opening 17T is performed.

Here, control device 40 checks that front door 19 is closed by locking and performs the moving operation of mask 15 from printing-job performing position P2 to mask shelter position P3. In addition, a lock switch of front door 19 is desired to include a malfunction detecting circuit, and in a case of malfunction, a notice of malfunction is provided to operator OP through touch panel 41. Further, after Step ST 8 in FIG. 10, front door 19 is closed, and it is desirable to performed malfunction detection of internal sensor 33 and external sensors 34 in a state in which mask 15 is not present. When internal sensor 33 and external sensors 34 are reflective sensors, operator OP checks that inspection light does not return back.

Between Step ST6 and Step ST7, even in a case where operator OP mistakenly inserts mask 15 reversely from mask picking-up opening 17T, a system stops and safety is ensured. In addition, it is desirable to dispose inspection region setter 32 such that a distance from inspection region setters 32 to a hazard source becomes a distance in which it is impossible for a foreign object to reach the hazard source in a period of time from detection of the foreign object (hand) inserted from mask picking-up opening 17T by inspection region setter 32 to stop of the hazard source.

As described above, in screen printing apparatus 1 (and a screen printing method used by screen printing apparatus 1) in the exemplary embodiment, inspection plane KM is formed in a plane intersecting with the moving path of mask 15 from printing-job performing position P2 to mask shelter position P3 at which mask 15 (used mask 15) is positioned. The operation of the predetermined operating mechanism is stopped in a case where detection of an inserted object that crosses inspection region LC is performed except for a case where mask 15 moving from printing-job performing position P2 to mask shelter position P3 by squeegeeing mechanism 16 crosses inspection plane KM. Therefore, operator OP can pick up used mask 15 from mask picking-up opening 17T in a state in which safety is ensured even during a printing job. Hence, according to screen printing apparatus 1 (and the screen printing method) in the exemplary embodiment, an operator can pick up a mask during a screen printing job while safety of the operator is ensured, and thus it is possible to improve the work efficiency. In other words, a screen printing job is stopped and then mask replacement is performed in the related art; however, in the exemplary embodiment, operator OP can pick up mask 15 after printing is finished without stopping a screen printing operation except for a case where a hazard is detected. As a result, it is possible to improve the efficiency of the printing job.

In the exemplary embodiment, after detection of mask 15 reaching mask shelter position P3 is performed, front door 19 as a door member is opened and mask 15 is picked up from the mask picking-up opening 17T. During a period from this time to detection of front door 19 that is closed, front door 19 is in the opened start. In other words, except for the period, front door 19 is locked in the closed state. Thus, after used mask 15 is picked up from mask picking-up opening 17T and front door 19 is closed, front door 19 is in a locked state in a closed posture. Therefore, regarding front door 19, unless used mask 15 is in a state of being positioned at mask shelter position P3, it is not possible to open front door 19 in principle (without another procedure such as unlocking by another separately provided mechanism separately). In this manner, unnecessary opening of front door 19 is regulated, and thus it is possible to reduce a chance in which operator OP mistakenly inserts his or her hand from mask picking-up opening 17T. In this respect, it is also possible to ensure safety of operator OP.

As described above, the exemplary embodiment is described hitherto; however, the present disclosure is not limited thereto as described above. For example, in the exemplary embodiment described above, external sensors 34 have both of the function as the second detector and the function of the third detector. However, the second detector and the third detector may be configured as separate detectors. In addition, in the exemplary embodiment described above, internal sensor 33 as the first detector and external sensors 34 as the second detector and the third detector are light sensors; however, the first detector, the second detector, and the third detector are not necessarily limited to the light sensor.

In addition, there is considered a case where it is not possible for inspection region setter 32 to invalidate (perform the muting on) the region, through which mask 15 passes, with an inexpensive system, or a case where masks 15 are diversified depending on the application and thus a region to be invalidated is varied depending on mask 15 because the height of mask 15 is changed. In such a case, there may be employed a configuration in which the passing region of mask 15 is excluded by ignoring detection results of a region through which mask 15 passes from inspection region LC by operation stop controller 40*b* in control device 40 without stopping the detection operation by inspection region setter 32 only when mask 15 passes through inspection region LC. In addition, it may be possible for operator OP to set a region of which detection results are ignored depending on the height of inserted mask 15 in advance.

In the exemplary embodiment described above, squeegeeing mechanism 16 serves as the moving mechanism of moving mask 15 from printing-job performing position P2 to mask shelter position P3. However, squeegeeing mechanism 16 does not serve as the moving mechanism, and a dedicated mechanism disposed to move mask 15 may be used.

In the exemplary embodiment described above, for the convenience of description, an example in which next mask 15 for printing is inserted from a rear portion of screen printing apparatus 1, and used mask 15 is picked up from a front portion of screen printing apparatus 1 is described. However, according to an equipment configuration of a factory line, a reverse configuration thereof may be employed. Further, in the exemplary embodiment described above, a system in which the locking mechanism (front-door locking mechanism 19*b*) is provided on front door 19 is described. However, even when a system in which the locking mechanism is not provided on front door 19 is provided, it is possible to detect a foreign object by inspection region setters 32 in a system in which mask 15 can jump out and a foreign object can be mixed thereto, and safety is improved. In the exemplary embodiment described above, detection is performed by using the non-contact sensors with respect to mask 15. Therefore, since a detecting tool does not come into contact with mask 15, mask 15 is less damaged. There is a possibility that paste Pst remains on used mask 15; however, in the exemplary embodiment, used mask 15 does not come to contact with another portion of screen printing apparatus 1, and thus there is little possibility that paste Pst is scattered inside the screen printing apparatus 1 having the configuration. In addition, since a movable component or a movable sensor is not used for a detector, there is little possibility of malfunction.

Hence, this disclosure provides the screen printing apparatus and the screen printing method in which it is possible to ensure the safety of an operator, the operator can pick up a mask during the screen printing job, and thus it is possible to improve the work efficiency.

What is claimed is:

1. A screen printing apparatus that performs printing paste on a board via a mask positioned at a printing-job performing position and causes a moving mechanism to position a used mask at a mask shelter position such that it is possible to pick up the mask positioned at the mask shelter position from a mask picking-up opening, the apparatus comprising:

an inspection region setter that sets an inspection region in an inspection plane that intersects with a moving path of the mask until the mask positioned at the printing job performing position moves to the mask shelter position by the moving mechanism; and an operation stop controller that stops an operation of a predetermined operating mechanism in a case of detecting an inserted object inserted from the mask picking-up opening which crosses the inspection region, the inspection region setter being configured to exclude a passing region of the mask from the inspection region in a configuration in which the mask, to be positioned at the mask shelter position, passes over the inspection plane from the printing-job performing position.

2. The screen printing apparatus of claim 1, further comprising:

a first detector that detects a state in which the mask moving from the printing-job performing position to the mask shelter position by the moving mechanism starts crossing the inspection plane; and a second detector that detects a state in which the mask moving from the printing-job performing position to the mask shelter position by the moving mechanism finishes crossing the inspection plane, wherein the inspection region setter excludes the passing region of the mask from the inspection region between the detection of the state in which the mask starts crossing the inspection plane by the first detector and the detection of the state in which the mask finishes crossing the inspection plane by the second detector.

3. The screen printing apparatus of claim 2, wherein the first detector and the second detector are non-contact sensors with respect to the mask moving by the moving mechanism.

4. The screen printing apparatus of claim 1, further comprising:

a cover member provided with the mask picking-up opening;

a door member that is provided on the cover member and openably covers the mask picking-up opening;

an opened/closed state detector that detects an opened/closed state of the door member;

a third detector configured to detect that the mask has reached the mask shelter position upon the mask moving from the printing-job performing position to the mask shelter position;

a locking mechanism that locks the door member in the closed state such that the door member is locked in the closed state; and an unlocking controller that unlocks a locked state performed by the locking mechanism after the third detector detects that the mask reaches the mask shelter position.

5. The screen printing apparatus of claim 4, wherein the third detector is a non-contact sensor with respect to the mask moving by the moving mechanism.

6. The screen printing apparatus of claim 1, wherein the inspection region is formed by an inspection light curtain of a plurality of parallel beams of inspection light which are aligned to have a linear curtain shape in the inspection plane.

7. The screen printing apparatus of claim 1, wherein the moving mechanism has a mechanism of performing printing on the board under the mask with the paste on the mask, by a squeegee.

8. The screen printing apparatus of claim 1, wherein the passing region has a horizontal component extending between the inspection plane and the mask picking-up opening, and a vertical component extending from a surface supporting the mask in the passing region to a height that is less than a height of the mask picking-up opening.

9. A screen printing method used by a screen printing apparatus that performs printing paste on a substrate via a mask positioned at a printing job performing position and causes a moving mechanism to position a used mask at a mask shelter position such that it is possible to pick up the mask positioned at the mask shelter position from a mask picking-up opening, the method comprising:

setting an inspection region in an inspection plane that intersects with a moving path of the mask until the mask positioned at the printing-job performing position moves to the mask shelter position by the moving mechanism;

excluding a passing region of the mask from the inspection region in a configuration in which the mask, to be positioned at the mask shelter position, passes over the inspection plane from the printing-job performing position; and stopping an operation of a predetermined operating mechanism in a case of detecting an inserted object inserted from the mask picking-up opening which crosses the inspection region.

10. The screen printing method of claim 9, wherein the passing region has a horizontal component extending between the inspection plane and the mask picking-up opening, and a vertical component extending from a surface supporting the mask in the passing region to a height that is less than a height of the mask picking-up opening.

11. The screen printing method of claim 9, wherein the excluding the passing region occurs temporarily only at a time where a portion of the mask is disposed downstream of the inspection plane, and wherein the passing region is not otherwise excluded from the inspection region.

12. A screen printing apparatus that performs printing paste on a board via a mask positioned at a printing-job performing position and causes a moving mechanism to position a used mask at a mask shelter position such that it is possible to pick up the mask positioned at the mask shelter position from a mask picking-up opening, the apparatus comprising:

an inspection region setter that sets an inspection region in an inspection plane that intersects with a moving path of the mask until the mask positioned at the printing job performing position moves to the mask shelter position by the moving mechanism; and an operation stop controller that stops an operation of a predetermined operating mechanism in a case of detecting an inserted object inserted from the mask picking-up opening which crosses the inspection region, wherein the inspection region setter excludes a passing region of the mask from the inspection region in a configuration in which the mask, to be positioned at the mask shelter position, passes over the inspection plane from the printing-job performing position, further comprising a cover member provided with the mask picking-up opening;

a door member that is provided on the cover member and openably covers the mask picking-up opening;

an opened/closed state detector that detects an opened/closed state of the door member;

a third detector that detects that the mask has reached the mask shelter position upon moving from the printing-job performing position to the mask shelter position;

a locking mechanism that locks the door member in the closed state such that the door member is locked in the closed state; and an unlocking controller that unlocks a locked state performed by the locking mechanism after the third detector detects that the mask reaches the mask shelter position.

13. The screen printing apparatus of claim 12, wherein the third detector is a non-contact sensor with respect to the mask moving by the moving mechanism.

* * * * *